United States Patent [19]

Ingerdahl

[11] 4,024,659

[45] May 24, 1977

[54] ADJUSTABLE PICTURE FRAME

[75] Inventor: John Ingerdahl, Copenhagen, Denmark

[73] Assignee: I/S Biodan, Copenhagen, Denmark

[22] Filed: Nov. 25, 1975

[21] Appl. No.: 635,162

[30] Foreign Application Priority Data

Dec. 4, 1974 Denmark ..... 6300/74

[52] U.S. Cl. ..... 40/155; 52/656; 248/188.5

[51] Int. Cl.[2] ..... G09F 1/12

[58] Field of Search ..... 40/155, 152, 209, 125 H, 40/152.1; 248/407, 188.5, 354 P, 429; 52/656, 658, 475, 476, 217, 632, 758 H, 758 N

[56] References Cited

UNITED STATES PATENTS

| | | | |
|---|---|---|---|
| 1,540,482 | 6/1925 | Landaal | 40/155 |
| 1,646,049 | 10/1927 | Boye | 248/188.5 X |
| 1,792,714 | 2/1931 | Shields | 248/188.5 X |
| 2,136,906 | 11/1938 | McAdams | 40/155 X |
| 2,866,286 | 12/1958 | Hartman | 40/155 |
| 3,171,627 | 3/1965 | Tapley et al. | 248/408 X |
| 3,451,153 | 6/1969 | Dohanyos | 40/155 |

*Primary Examiner*—John F. Pitrelli
*Attorney, Agent, or Firm*—Finnegan, Henderson, Farabow & Garrett

[57] ABSTRACT

An adjustable picture frame comprising a plurality of inner and outer frame members telescopically displaceable with respect to each other. Each frame member has a front wall, two opposed sidewalls and a back wall. The picture frame has an arresting stud with rounded cam surfaces mounted within each inner frame member so as to project through an opening formed in one side wall thereof and a spring member urges the arresting stud to bear against the adjacent side wall of the associated outer frame member. At least two longitudinally spaced openings are formed in the adjacent side wall for receiving the arresting stud to thereby releasably hold the inner and outer frame members in a predetermined relative position. A blocking stud is mounted within each inner frame member so as to project through an opening formed in the side wall thereof opposite to said first side wall. The blocking stud has a rounded cam surface facing the outer end of the inner frame member, and a blocking surface extending substantially perpendicular to the longitudinal direction of the frame members and located oppositely to said rounded cam surface. A spring means urges the blocking stud to bear against the adjacent side wall of the associated outer frame member. An opening formed in the adjacent side wall near to the outer end of the outer frame member receives the blocking stud to prevent further outward movement of the inner frame member with respect to the frame member, while allowing relative movements of the frame members in the opposite direction.

2 Claims, 3 Drawing Figures

ADJUSTABLE PICTURE FRAME

Figure 1:
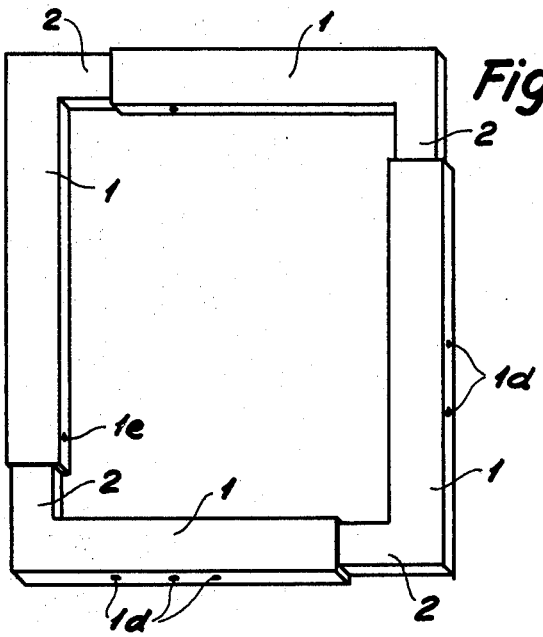

Picture posters and playbills have generally been put up in the cinema showcases by means of thumtacks or staples pushed through the picture and into a soft back plate, for instance a celotex plate. After repeated putting up and taking down in this way the pictures will be perforated in the corners, which will gradually be ruined. Also the soft back plate will be so damaged after some time in use by the many perforations that it will have to be replaced.

The specification of Danish Patent Application No. 5262/73 illustrates and describes a picture frame to be used for putting up picture posters in cinema showcases and comprising a light frame, for example of aluminum, and the rear surface of which is provided with magnets for retaining the frame on a surface of magnetizable material, for instance an iron plate which is the back plate of the show case.

Such frames greatly facilitates the work of putting up and removing the posters and no damage is caused either to pictures or to back plate.

Film pictures, however, are generally supplied in several different formats and a very great number of frames are required to cover any need. This drawback can theoretically be overcome by providing adjustable frames, the dimensions of which can be adjusted to the conventional formats of pictures. Such an adjustable frame has been illustrated and described in the specification of Danish Pat. No. 56,810. This known frame comprises four angular corner members wherein thin-walled side members are telescopically displaceable and lockable in any desired position by means of a pivotable locking plate which in the locked position urges the thin walls of the side member firmly against the inner face of the walls of the corner member.

But frames like this would be very troublesome and fatiguing to use for putting up film pictures on account of the large number of pictures, each of which would require adjustment of at least four and at worst eight side member ends in the corner members.

The present invention relates to an adjustable picture frame comprising frame members which are telescopically displaceable in each other, and it is the object of the invention to provide a picture frame of the said type which is readily adjustable to any of a given number of formats and therefore specifically suitable for putting up film pictures.

This object has been accomplished by a frame in which one or more of the inner frame members, preferably all of the inner frame members, comprise an arresting stud projecting through an opening in the frame member and urged by a spring into engagement with the outer frame member in which are provided at least two openings or recesses into which the arresting stud can enter when subjected to the action of the spring. The spring actuated arresting studs in cooperation with the openings or recesses in the outer frame members provide a clear definition of the relative positions of the inner and outer frame members corresponding to the said openings or recesses, and the said positions in turn correspond to predetermined format dimensions.

The arresting stud is formed with opposite inclined, respectively forwardly and rearwardly facing cam surfaces, which enables it to be disengaged from the opening or recess by the exertion of a suitable pull in or pressure on the two frame members. The magnitude of the required pull or pressure, besides depending on the shape of the stud and the opening or recess, also depends on the spring tension to which the stud is subjected.

In one or more, preferably in each of the inner frame members may further be provided a blocking stud extending through an opening in the frame member and urged by a spring into engagement with the outer frame member, in which is provided an opening or a recess into which the blocking stud can enter as a result of the action of the spring when the two frame members have their maximum total length. This stud ensures that the inner frame members cannot inadvertently be withdrawn entirely from the outer frame members during the adjustment procedure, which would have caused unnecessary and time-consuming assembly work.

In that construction the said blocking stud may expediently have a rearward surface disposed substantially perpendicular to the longitudinal direction of the frame members and a forwardly facing inclined cam face. This ensures the desired blocking effect and enables disengagement of the blocking stud from the opening or recess by the exertion of a suitable pressure against the two frame members.

Both the arresting stud and the blocking stud may be formed as sideways extending projections on respective legs of substantially U-shaped flat spring mounted in tension between oppposed walls of the inner frame member so that the two studs and the spring forms a single element which may be punched from spring steel and which simplifies and cheapens the picture frame.

Figure 3:
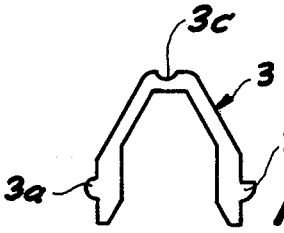
Figure 2:
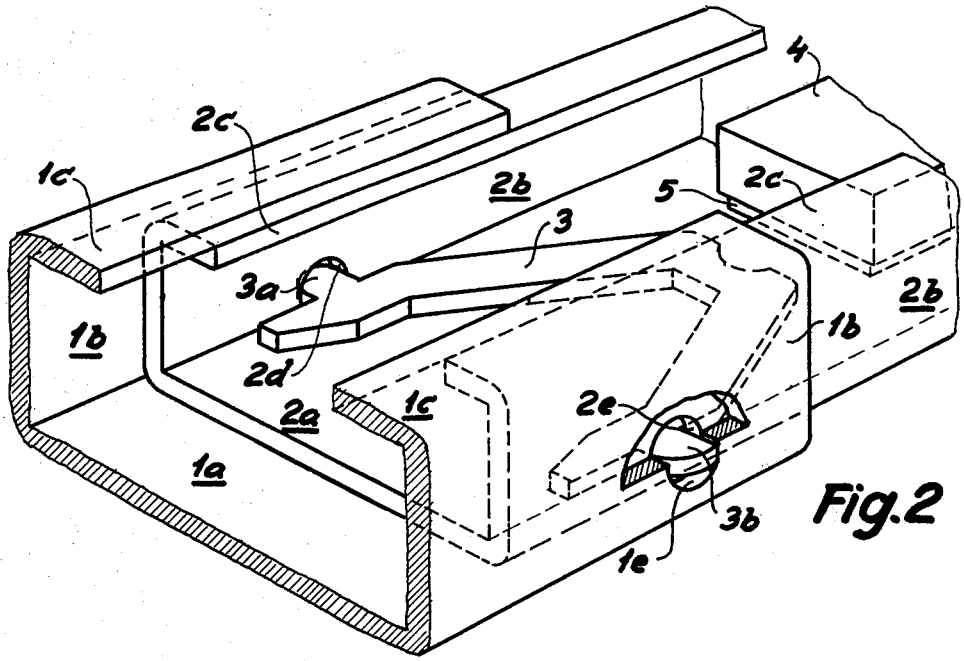

The invention will be explained in greater detail below with reference to the drawing, in which FIG. 1 is a perspective presentation of an embodiment of the picture frame according to the invention, FIG. 2 is a perspective presentation showing on a larger scale a section through an outer frame member at the end of the inner frame member, and FIG. 3 is a full scale presentation of a spring element with projections used in the frame.

The picture frame shown in FIG. 1 is composed of four angular frame members, 1, 2 made from a thin sheet material, for example iron or aluminum, which, as shown in FIG. 2, is bent to form a flat channel with a bottom 1*a* or 2*a*, side walls 1*b* or 2*b* and inwardly bent edge flanges 1*c* or 2*c*. One leg 2 of each frame member 1, 2 is so much narrower than the other leg 1 that it can be inserted with a sliding fit into the broader leg of another frame member, and the four frame members are telescoped into each other as indicated in FIGS. 1 and 2.

Adjacent to the free end of each inner frame member 2 and inwardly of that member is provided a substantially U-shaped spring element 3, which is shown in FIG. 3 and which may be punched from spring steel. On the outer side of the legs of the spring element and adjacent to the free ends thereof is provided a projection 3*a* and 3*b*, one of which 3*a* is rounded with opposite inclined side edges, while the other 3*b* has forwardly inclined side edge and a rearwardly facing side edge disposed substantially perpendicular to the end portion of the said leg. As will appear from the following, the latter edge forms a blocking edge while the inclined side edges of projections 3*a* and 3*b* form cam edges. A notch 3*c* in the central portion of the spring element serves to impart adequate elasticity to the element.

As shown in FIG. 2 each spring element 3 is tensioned within the inner frame member 2 so that the elastic force will urge the legs against respective side walls 2*b* of the frame member which are provided with holes 2*d* and 2*e* for receiving the projections 3*a* and 3*b* respectively.

In the outer side wall 1*b* of each outer frame member 1 are provided a plurality of holes 1*d* which are so disposed that in a certain position of the frame member 1 in relation to the inner frame member 2 each hole 1*d* will be aligned with a hole 2*d* in the side wall 2*b*. In this position the projection 3*a* of the spring element will be urged into the said hole 1*d* by the elastic force of the element, and the position will be clearly defined by the fact that it requires the application of a certain force on the frame members in their longitudinal direction to press the projection 3*a* out of the hole 1*d* against the action of the elastic force of the spring element by the cam action between an edge portion of the hole 1*d* and one of the inclined side edges of the projection 3*a*. The magnitude of the force required depends on the shape, nature and relative positions of the cooperating edge faces and on the rigidity or elasticity of the spring element.

Moreover the inner side wall 1*b* of each outer frame member 1 is provided with a hole 1*e* which is disposed to be aligned with the hole 2*e* in the inner side wall 2*b* of the inner frame member when the two frame members assume the relative positions corresponding to the maximum length of the said frame side. In that position the projection 3*b* of the spring element will be urged into the hole 1*e* by the elastic force of the element, and when the blocking edge of the projection impinges on an edge portion of the hole 1*e* further withdrawal of the inner frame member from the outer frame member will be prevented. The insertion of the inner frame member into the outer frame member is made possible by the forwardly inclined cam edge of the projection 3*b* which in cooperation with an edge portion of the hole 1*e* can urge the projection 3*b* out of that hole against the spring action by the exertion of a suitable pressure against the two frame members in their longitudinal direction.

It will be seen that the projection 3*a* on the spring elements 3 form arresting studs that serve to define predetermined relative positions of the inner and outer frame members and that the projections 3*b* form blocking studs that prevent complete withdrawal of the inner frame members from the outer frame members and simultaneously determine the relative positions corresponding to the maximum side length.

In the illustrated embodiment there are three external holes 1*d* in two frame sides and two external holes 1*d* in the two other frame sides and this, in connection with the internal hole 1*e* in each of the four frame sides, provides $3 \times 4 = 12$ different defined possibilities of adjustment.

As shown in FIG. 2 a rodshaped permanent magnet 4 is provided behind the spring element 3 in the inner frame 2. This makes it possible to attach the frame to a wall or plate of magnetizable material. Owing to the torsional strain and the consequent minor deformations to which the frame will inevitably be exposed in practical use, the magnet has been secured to the bottom 2*a* of the inner frame member by means of a relatively thick strip 5 of resilient material coated on both sides with an adhesive.

The structural details of the illustrated and described picture frame, for instance the cross-sectional shape of the frame members and the shape of the spring element and its projections, may be modified in many ways within the scope of the invention. The spring element may, if desired, be substituted by two separate springs for acting respectively on the arresting stud and on the blocking stud. Instead of being composed of four angular members 1, 2 of different cross-sectional dimensions of the two legs, the frame may be composed of four angular corner members with identical legs and four separate side members which can be telescoped into the corner members.

What we claim is:

1. An adjustable picture frame comprising a plurality of inner and outer frame members which are telescopically displaceable with respect to each other, each frame member having a front wall, two opposed sidewalls and a back wall, said picture frame further having an arresting stud with rounded cam surfaces mounted within each inner frame member so as to project through an opening formed in one side wall thereof, a spring member urging said arresting stud to bear against the adjacent side wall of the associated outer frame member, and at least two longitudinally spaced openings formed in said adjacent side wall for receiving said arresting stud to thereby releasably hold the inner and outer frame members in a predetermined relative position;

a blocking stud mounted within each inner frame member so as to project through an opening formed in the side wall thereof opposite to said first side wall, said blocking stud having a rounded cam surface facing the outer end of said inner frame member, and a blocking surface extending substantially perpendicular to the longitudinal direction of the frame members, and located oppositely to said rounded cam surface, a spring means urging said blocking stud to bear against said adjacent side wall of the associated outer frame member, and an opening formed in said adjacent side wall near to the outer end of said outer frame member for receiving said blocking stud, thereby preventing further outward movement of said inner frame member with respect to said outer frame member while allowing relative movements of the frame members in the opposite direction.

2. An adjustable picture frame according to claim 1 in which said arresting stud and said blocking stud are constituted by respective laterally and oppositely extending projections on respective legs of a substantially U-shaped flat spring forming said spring means and being mounted in tension between said opposed walls of said inner frame member.

* * * * *